US009750961B2

(12) United States Patent
Leicester

(10) Patent No.: US 9,750,961 B2
(45) Date of Patent: Sep. 5, 2017

(54) SAFETY HARNESS

(76) Inventor: Gordon Charles Leicester, Hickstead Sussex (GB)

( * ) Notice: Subject to any disclaimer, the term of this patent is extended or adjusted under 35 U.S.C. 154(b) by 1095 days.

(21) Appl. No.: 13/254,389

(22) PCT Filed: Dec. 7, 2009

(86) PCT No.: PCT/GB2009/051656

§ 371 (c)(1),
(2), (4) Date: Sep. 1, 2011

(87) PCT Pub. No.: WO2010/100395

PCT Pub. Date: Sep. 10, 2010

(65) Prior Publication Data

US 2012/0023638 A1 Feb. 2, 2012

(30) Foreign Application Priority Data

Mar. 3, 2009 (GB) ..... 0903534.6

(51) Int. Cl.
*A62B 35/00* (2006.01)
*A41D 13/00* (2006.01)
*A41F 19/00* (2006.01)

(52) U.S. Cl.
CPC ..... *A62B 35/0018* (2013.01); *A41D 13/0007* (2013.01); *A62B 35/00* (2013.01); *A62B 35/0025* (2013.01); *A41F 19/00* (2013.01)

(58) Field of Classification Search
CPC ..... A62B 35/00; A62B 35/0018; A62B 35/0025; A41D 13/0007; A41F 9/025; A41F 19/00; A41F 3/00
(Continued)

(56) References Cited

U.S. PATENT DOCUMENTS 776,908 A * 12/1904 Henry ..... A61F 2/60 623/27
1,551,932 A * 9/1925 Carver ..... 297/466
(Continued)

FOREIGN PATENT DOCUMENTS

| | | |
|---|---|---|
| DE | 20 2008 004 980 U1 | 7/2008 |
| GB | 749717 | 5/1956 |
| WO | WO 01/12267 A1 | 2/2001 |

OTHER PUBLICATIONS

PCT/GB2009/051656 International Search Report.
GB 0903534.6 Search Report under Section 17.

*Primary Examiner* — Colleen M Chavchavadze
(74) *Attorney, Agent, or Firm* — Fay Sharpe LLP

(57) ABSTRACT

Safety harness (100) having an upper portion (6) for surrounding a torso of a wearer and a lower portion (8) configured to clutch calves of the wearer. The harness includes left and right guide straps (26) which extent from the upper portion (6) to the lower portion (8) and which each accommodate a tension member (54) which may be a steel cable which is slideable within a wear preventing sheath. The lower portion (8) includes clutching means (12) which have calf straps (38). A lower portion of each tension member (54) is laced between spaced ends of the one or more calf straps (38) in such a manner that tensioning of the tension member (54) causes one or more of the calf straps (38) to clutch a calf of the wearer. An upper portion of the tension member (54) is connected to or constitutes a lanyard (60) for connection to a restraint. The harness (100) may include a pair of overalls (102) or a pair of trousers.

20 Claims, 11 Drawing Sheets

(58) Field of Classification Search
USPC ..... 182/3; 2/309, 310, 311
See application file for complete search history.

(56) References Cited

U.S. PATENT DOCUMENTS 1,574,529 A 2/1926 Abraham
1,608,032 A * 11/1926 McNabb ..... A61F 5/0104 602/30
1,860,727 A * 5/1932 Ansley ..... A41F 19/00 2/305
2,274,574 A * 2/1942 Zerne ..... A61H 1/02 482/129
2,543,847 A * 3/1951 Hallstedt ..... A61H 3/00 602/4
3,869,021 A * 3/1975 Sutherland et al. ..... 182/3
4,065,814 A * 1/1978 Fox ..... A41D 13/02 2/227
4,252,112 A * 2/1981 Joyce ..... A61F 5/0104 601/34
5,652,957 A * 8/1997 Williford et al. ..... 2/22
6,190,342 B1 * 2/2001 Taylor ..... A61F 5/026 602/19
6,691,824 B2 * 2/2004 Sharp ..... 182/3
6,971,476 B2 * 12/2005 Wolner et al. ..... 182/3
7,596,815 B2 * 10/2009 Grilliot ..... A41D 13/0007 2/227
7,931,571 B2 * 4/2011 Bernardoni ..... A61F 5/0102 434/255
8,656,516 B1 * 2/2014 Reinhardt Rawlings ..... A41D 11/00 2/69
9,351,900 B2 * 5/2016 Walsh ..... A61H 1/024
2002/0074185 A1 * 6/2002 Colorado ..... 182/6
2005/0194211 A1 9/2005 O'Shall et al.
2007/0135279 A1 * 6/2007 Purdy ..... A63B 21/0004 482/124
2007/0169246 A1 * 7/2007 Sloan et al. ..... 2/81
2007/0246298 A1 * 10/2007 Botti ..... 182/3
2007/0278036 A1 12/2007 Barta et al.
2008/0000719 A1 1/2008 Jones
2008/0156583 A1 * 7/2008 Meeks ..... 182/9
2008/0263755 A1 * 10/2008 Grilliot et al. ..... 2/457
2008/0282442 A1 * 11/2008 Bauvois ..... 2/79
2009/0032333 A1 * 2/2009 Wolner et al. ..... 182/3
2009/0236176 A1 * 9/2009 Sheu ..... 182/3
2011/0030118 A1 * 2/2011 Pratchett ..... 2/81

* cited by examiner

SAFETY HARNESS

The present invention relates to safety harnesses and more particularly the type of safety harnesses worn by workers operating at heights at which the wearing of a safety harness is advisable or obligatory.

A typical safety harnesses is fabricated from straps which surround a wearer's torso and generally includes a waist strap and further straps which extend over the shoulders of the wearer. The harness may also include crotch straps which loop downwardly from the waist strap around a wearer's crotch. The straps are generally adjustable in length and the waist strap includes a releasable fastening to facilitate putting the harness on and taking it off. A lanyard, approximately one to two meters in length, is usually connected to a rear part of the harness and a releasable clip is provided at a distal end of the lanyard for connection to some form of restraint.

When the wearer of such a harness falls and is restrained by the harness, the wearer is likely to suffer from so-called suspension trauma if left suspended by the harness for a significant period of time. If a wearer is suspended in an upright position and does not move for a certain period of time the wearer will faint. Due to the fact that the wearer will remain stationary and in an upright position, the wearer's brain will be deprived of oxygenated blood. This can prove fatal in as short a period as 12 minutes. In normal situations, when a person faints they fall over which results in the brain being lowered relative to the rest of the person's body which in turn increases the blood flow to the brain.

An object of the present invention is to provide a safety harness which overcomes at least the above problem.

According to the invention there is provided a safety harness including support attachment means and calf clutching means for at least partly supporting a wearer of the harness by the calf clutching means clutching calves of the wearer, the harness being configured such that applying a support load to the support attachment means causes clutching of the calf clutching means around calves of the wearer. With such a safety harness, when a wearer is supported by the harness, due to the fact that at least part of the support is provided by the calf clutching or gripping means supporting legs of the wearer below the knees, slight movement of the wearer's legs in combination with loading of the legs by their support of upper parts of the wearer's body will result in an adequate flow of oxygenated blood reaching the wearer's brain. Fainting and consequent suspension trauma are thereby avoided. The reference to a calf is intended to refer to a portion of a leg between its knee and its ankle.

Preferably the harness includes tensioning means which extends from the support attachment means to a lower harness portion including the calf clutching means. Such tensioning means can conveniently transfer load from a conventional anchor point of a harness in the centre of a wearer's chest or back to the calf clutching means.

In order to reduce the chance of the tensioning means from becoming snagged, and possibly getting into the wrong position when the harness is being put on, preferably the tensioning means is arranged to run through an upper harness portion. The tensioning means may run through a rigid annular member and/or tubular fabric parts of the upper harness portion. So as to reduce chafe the tensioning means may run through a protective sheath.

Preferably the calf clutching means includes at least one flexible member configured to extend around each leg of the wearer. Each flexible member may be configured to extend only the majority of the way around each leg of the wearer and can act to distribute force exerted by the calf clutching means on the leg.

The tensioning means is preferably arranged to urge portions, such as ends, of the flexible member towards each other thereby causing the flexible member to clutch a calf of the wearer when the tensioning means is tensioned. Such an arrangement provides a convenient way of converting tensile force in the tensioning means to a clutching force provided by the clutching means. Conveniently the tensioning means may be laced between portions, such as ends, of one or more of the flexible members.

Portions of the at least one said flexible member may alternatively be connected by at least one loop and the tensioning means may be connected to the at least one loop whereby the portions of the at least one said flexible member are urged towards each other when the tensioning means are tensioned.

Preferably the harness includes an item of clothing in the form of a pair of trousers or overalls with which other parts of the harness are releasably or permanently connected. With such an arrangement the putting on and taking off of the harness will be greatly facilitated and significantly reduce the chance of the harness being put on incorrectly. Furthermore by making the harness a part of a worker's regular clothing, the problem of a worker not bothering to put a harness on can be avoided thereby encouraging safe working practices. The reference to permanent connection is intended to mean that in normal use the parts of the harness, including the item of clothing, remain connected together.

The harness may include a guide connected to the item of clothing defining a passage through which the tensioning means extends. The guide may be openable along its length to facilitate separation of the item of clothing from other parts of the harness for cleaning and inspection purposes.

Where the harness includes, as an integral part thereof, an item of clothing, the tensioning means is preferably at least partly routed by connection to the item of clothing. Such an arrangement will help to retain the tensioning means in the correct position and reduce the chance of it becoming snagged. For similar reasons the harness preferably also includes a cover for at least partly covering the calf clutching means.

The calf clutching means may conveniently be in the form of a clenchable gaiter for each leg of the wearer. Such an arrangement will provide a well distributed gripping force on the user's legs.

Since the tensioning means may get in the way of a worker unnecessarily when the worker is working at low level, and accordingly does not need to connect the harness to a restraint, the harness preferably includes a retention means for retaining a portion of the support attachment means in such situations. Such retention means may conveniently be in the form of a pocket. To further prevent the support attachment means from causing an obstruction it may be connected to and or routed via a back of the harness.

Although positioning parts of the harness permanently under a wearer's shoes should be avoided due to the danger of such a part becoming damaged and/or causing the user to trip, when there is a requirement to use the harness to lower or raise the wearer, the harness preferably includes stirrups which are selectively deployable to provide support to undersides of feet of the wearer. So as to minimise the problems referred to above these stirrups are preferably at least partly accommodatable within bottoms of leg portions of the item of clothing.

To reduce the tendency of the calf clutching means to ride up the wearer's legs when the tensioning means is tensioned and at other times, bottoms of the legs of the item of clothing are preferably adjustable so as to grip ankles of the wearer.

The invention will now be described by way of example only with reference to the accompanying drawings in which.

Figure 1:
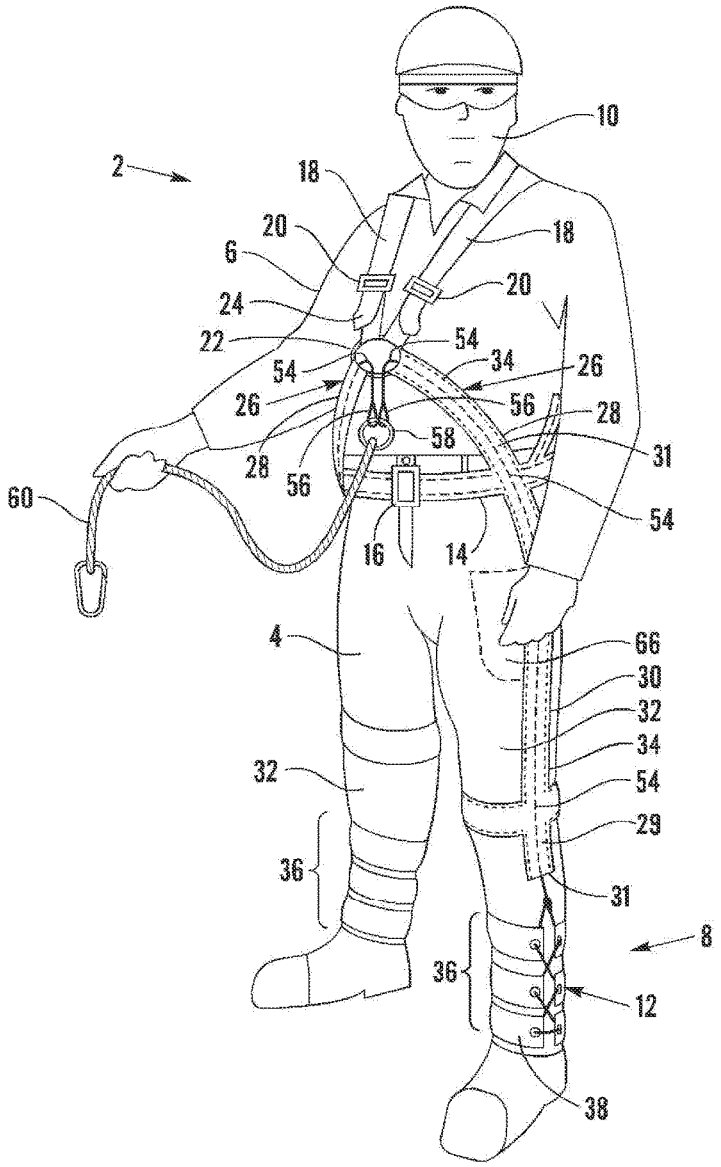
FIG. 1 shows a safety harness in accordance with a first embodiment of the invention on a wearer.
Figure 2:
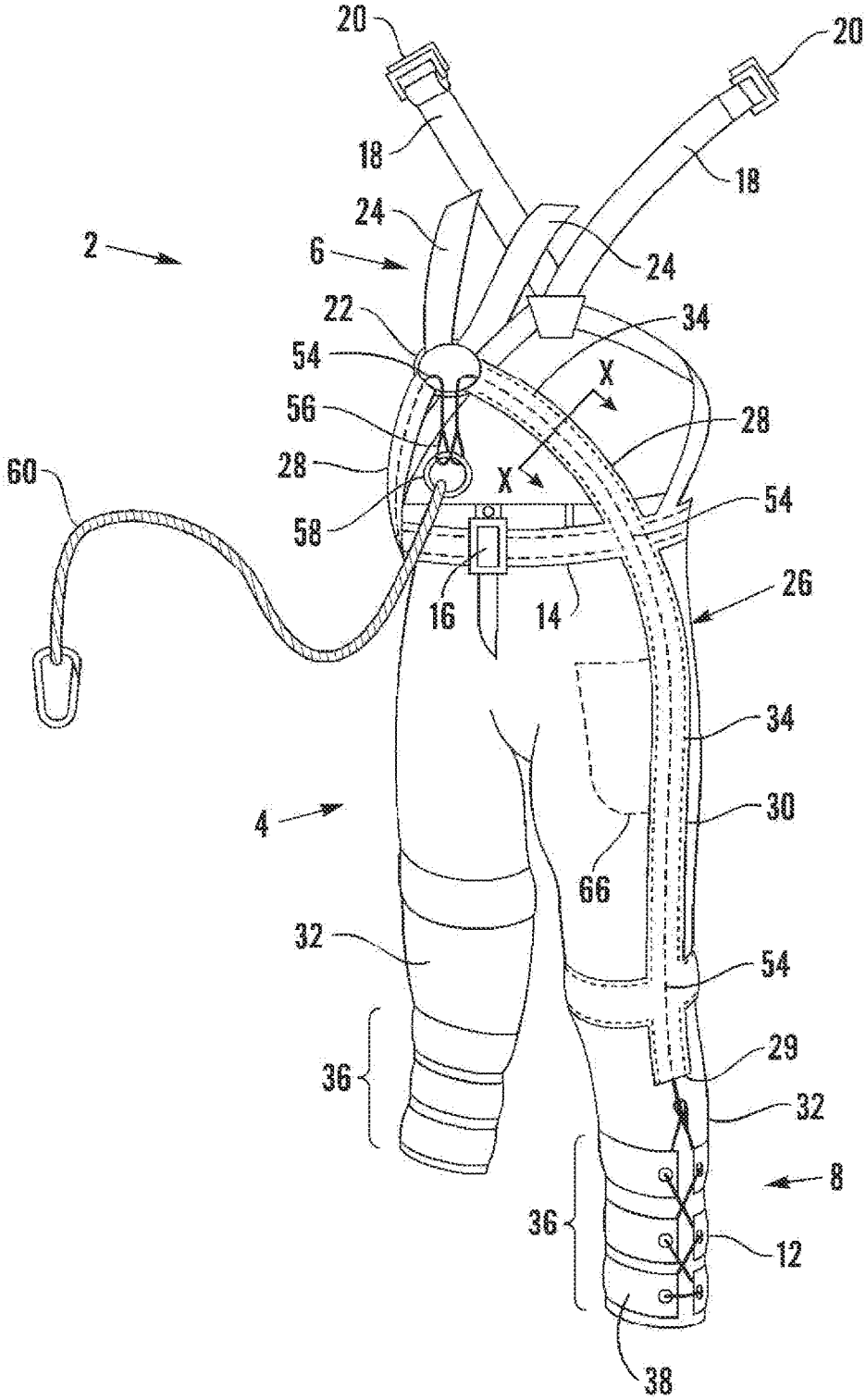
FIG. 2 shows the safety harness of FIG. 1 not on a wearer.
Figure 6:
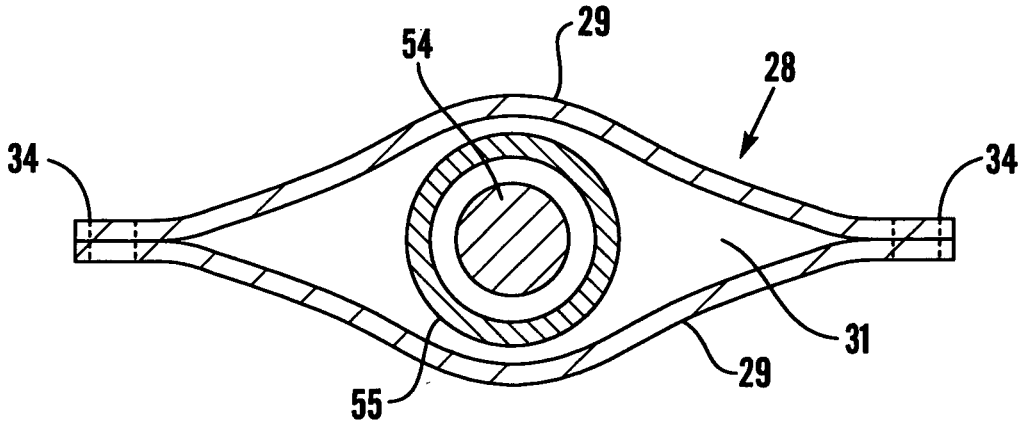
FIG. 6 shows a cross-section on the line XX through the upper guide strap shown in FIG. 2.

FIG. 1 shows a safety harness 2 according to a first embodiment of the invention which includes a pair of trousers 4. The harness includes an upper portion 6 which is configured to surround the torso of a wearer 10 and a lower portion 8 which includes clutching or gripping means 12 which will be described in detail below. The upper portion 6 includes a waist strap 14 which is securely connected to the pair of trousers 4 adjacent a waistband of the trousers by stitching and includes a waist buckle 16. A pair of shoulder straps 18 extend upwardly from side or rear parts of the waist strap 14 and are terminated with shoulder strap buckles 20. A ring 22 is positioned at the front of the upper portion of the harness. The ring 22 is rigid and preferably made of metal such as steel. Two chest straps 24 extend upwardly from the ring 22 and have plain ends for threading adjustably into the shoulder strap buckles 20. A pair of guide straps 26 extend downwardly from the ring 22. Each guide strap 26 comprises an upper guide strap part 28 which extends down to the waist strap 14 and a lower guide strap part 30 and which extends downwardly from the waist strap 14 to the clutching means 12. A cross-section through the upper-guide strap 28 on the line XX in FIG. 2 is shown in FIG. 6. Each upper guide strap 28 is made up from inner and outer pieces of webbing 29 sewn together along their edges with stitching 34 so as to define a passageway 31. Alternatively a single piece of webbing could be doubled over with edges thereof sewn together to form a tubular strap defining the passageway 31. The outer piece of webbing of the upper guide strap 28 continues downwardly past the waist strap 14 to form the lower guide strap 30 and is sewn, with stitching 34, to outer parts of legs 32 of the trousers 4 along edges of the lower guide strap 30 to form a continuation of the passageway 31.

Figure 3:
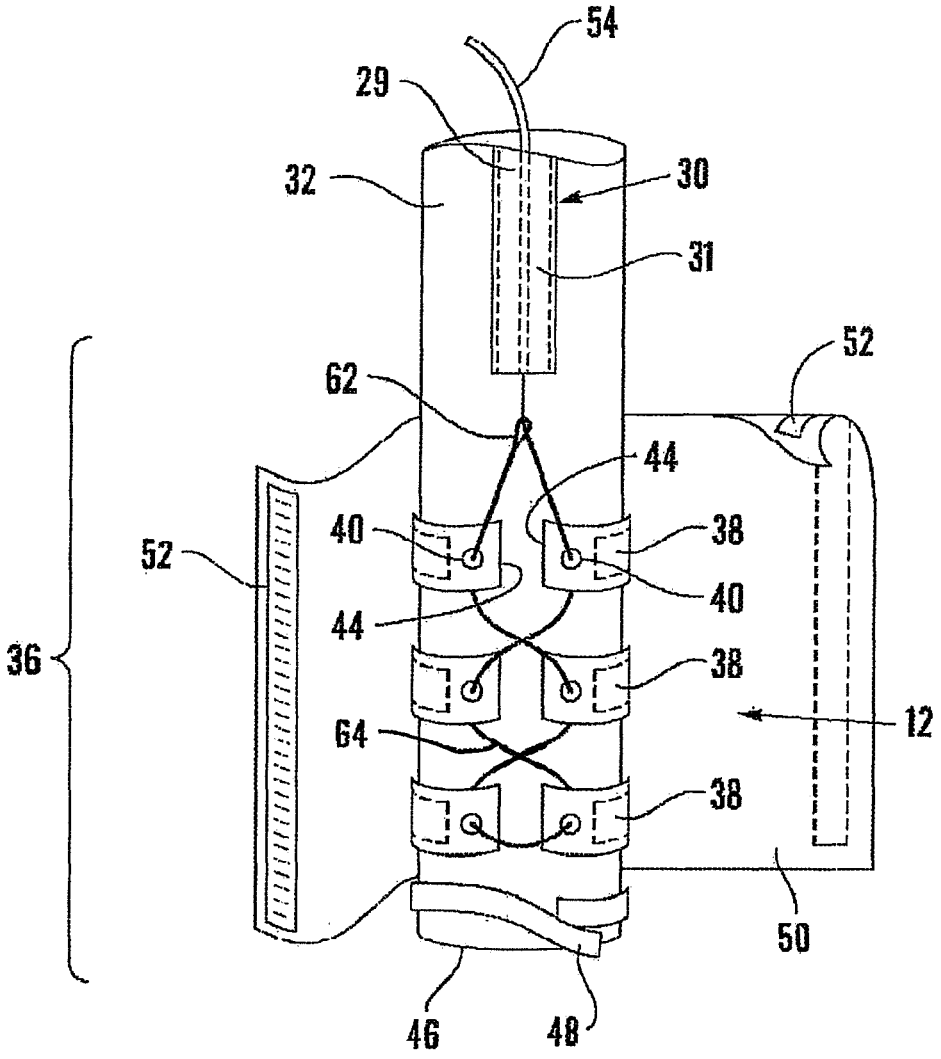
FIG. 3 shows a detail of the calf clutching means of the harness shown in FIG. 1.

A calf portion 36 of each leg 32, shown more clearly in FIG. 3, is provided with one of the clutching means 12. The clutching means includes a plurality of flexible members in the form of calf straps 38. Each calf strap 38 extends round the majority of the leg 32 and includes an eyelet 40 positioned adjacent each end 44 of the calf strap 38. A gap 42 is present between opposed ends 44 of each calf strap 38. The length of each calf strap 38 and the dimension of the gap 42 are designed such that drawing the opposed ends 44 towards each other results in a calf of a wearer of the harness being clutched by the calf strap 38.

While three calf straps 38 have been illustrated in each gripping means 12, a different number could be employed. Alternatively a single sheet of material could be employed to replace the three individual calf straps 38 with plural eyelets located adjacent opposed edges of the sheet.

At a bottom 46 of each leg 32 an ankle strap 48 is provided to permit the bottom 46 of the leg 32 to grip an ankle of a wearer in order to prevent the leg 32 of the trousers 4 from riding up the leg of the wearer 10 into a non-optimum position. The strap 48 will be provided with some convenient fastening means such as hook and loop fabric fastening means.

A cover 50 (omitted from FIGS. 1,2,4,9 and 10 for clarity) is provided to surround the gripping means 12 to prevent parts thereof from becoming snagged. Each cover 50 is in the form of a sheet of fabric which is sewn to the calf portion of one of the legs 32 on the opposite side of the leg 32 to that shown in FIG. 3 and includes hook and loop fabric fastening means 52 for securing the cover in place so that it surrounds and protects the clutching means 12.

Tensioning means in the form of two cables 54 is provided. Each cable is preferably a steel cable. The upper end of each cable 54 includes a loop 56, by means of which the cable 54 is connected to a ring 58 which in turn is connected to a lanyard 60 for securing to some kind of external restraint. The ring 58 and lanyard 60 constitute a support attachment means of the harness. The cables 54 may alternatively extend from the main part of the harness to form an integral lanyard which may be around one to two meters in length. Each cable passes through the ring 22, connecting the upper guide straps 28 to the chest straps 24, and then passes down through the passageway 31 defined by the upper and lower guide straps 28 and 30. As shown in FIG. 3 the cable extends out of the bottom of the passageway 31 and is laced back and forth between the eyelets 40 in the ends 44 of the calf straps 38. A distal end of the cable 54 includes a loop 62 through which the cable passes on exiting from the passageway 31. Where the cable 54 passes through the guide strap 26 it is preferably encased in a sheath 55 which may be made of a plastics material. Encasing the cable 54 in a sheath 55, through which it can slide, will prevent the cable from chafing against the webbing 29 and/or the pair of trousers 4 or overalls 68 which could cause damage which would not be easily detected by visual inspection of the harness.

All straps referred to above may be made of any suitably robust material such as webbing made from polyester, polypropylene, nylon or any other suitable material.

In use the lanyard 60 will be secured to an external restraint. If the user falls, descent will be arrested by the lanyard tensioning the cables 54. The cables will run through the ring 22 and passageways 31 to tension each cable 54 in the region of the respective clutching means 12. As the cable 54 is pulled into the passageway 31 it will be drawn through the loop 62 in the cable end and thereby tension the lacing 64. This will draw the ends 44 of the calf straps 38 together thereby tensioning the gripping means 12 around the respective calf of the user. As a consequence of this progressive tightening process, the user's descent will not be arrested abruptly. By spreading the arresting process over time and distance the tendency for the wearer to sustain injury will be significantly reduced. Furthermore, due to the fact that a large majority of the support of the wearer is provided by means of the clutching means clutching the calves of the wearer, the wearer's legs will still be supporting the majority of the wearer's body weight. The consequent use of the muscles in the wearer's legs will prevent the occurrence of suspension trauma as discussed above.

Figure 4:
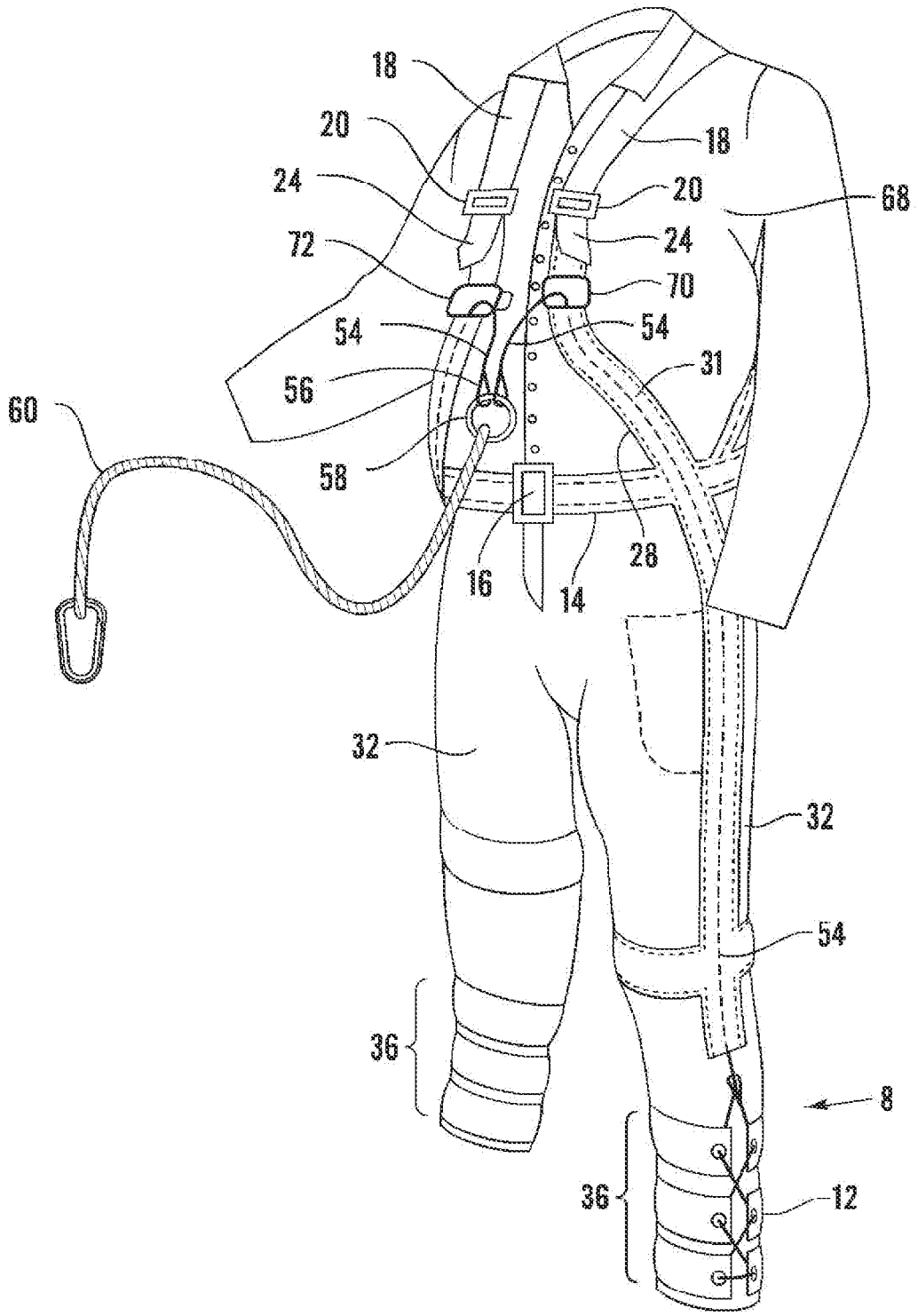
FIG. 4 shows a second embodiment of the invention.

A second embodiment 67 of the harness is shown in FIG. 4 in which the pair of trousers 4 of the first embodiment is replaced by a pair of overalls 68. Like parts are designated with the same numerals as used in connection with the description of the first embodiment. The upper guide straps 28, the chest straps 24 and the shoulder straps 18 are sewn to an upper part of the overalls 68. The upper guide straps 28 form the passageways 31 for the cables 54 by being sewn to the overalls instead of by being fabricated from two pieces of webbing being sewn together. The upper guide strap 28 and the chest strap 24 on the left hand side of the harness are connected by a left catch part 70 and the corresponding straps on the right hand side of the harness are connected by a complementary right catch part 72 which is releaseably engageable with the left catch part 70. The catch parts 70 and 72 are shown separated in FIG. 4. Each catch part may include an aperture (not shown) through which the respective cable 54 runs to reduce the chance of the upper guide straps 28 from being ripped from the pair of overalls 68 when the harness is used to arrest a user's fall.

When the harness of the first or second embodiment is worn, but not connected to an external restraint, the lanyard 60 and possibly upper portions of the cables 54 can be kept out of the way by being stored in a retention means such as a pocket 66. The retention means may also include means for connecting a loop of the lanyard/cables to the harness to prevent the loop from becoming snagged. This means for connecting may be in the form of hook and loop fabric joining means or some other suitable alternative.

Figure 5:
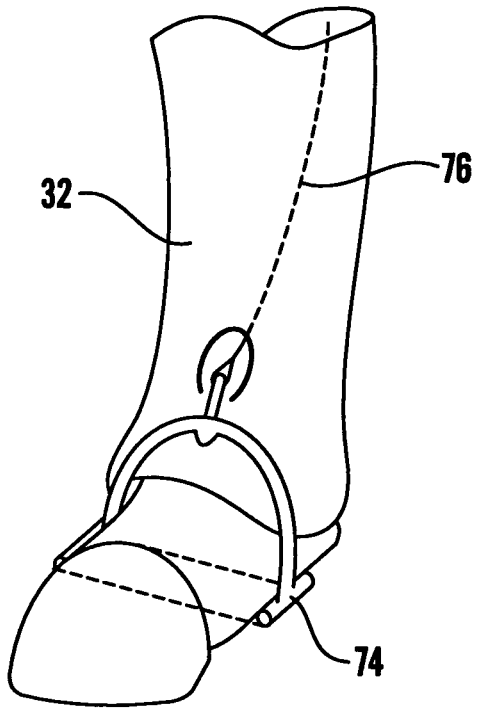
FIG. 5 shows a stirrup arrangement which may be incorporated in the various embodiments of the invention.

If the harness is to be used in a non-accident situation to raise or lower the wearer then the harness preferably includes a stirrup 74 located at the bottom of each leg 32 of the pair of trousers or overalls as shown in FIG. 5. Each stirrup 74 will be supported by a stirrup cable 76 which will be connected to a suitable part of the harness to provide support for the stirrups 74 to allow the wearer to effectively stand in the stirrups. The bottoms of the legs 32 of the trousers or overalls will preferably be adapted to accommodate the stirrups 74 when they are not being used to prevent them from becoming snagged or damaged.

Figure 7:
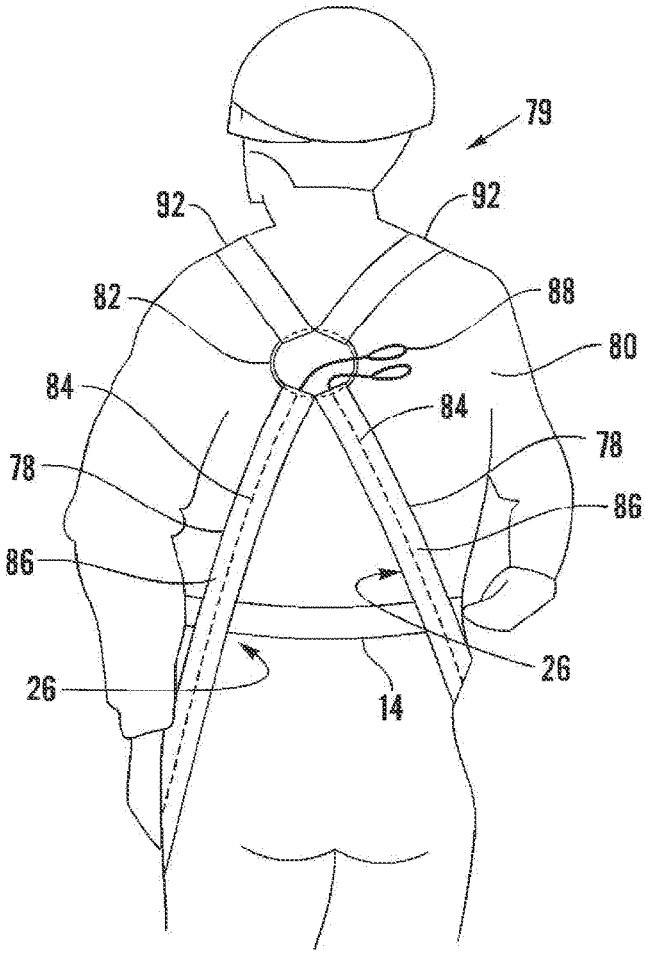
FIG. 7 shows a rear view of an upper portion of a third embodiment of the invention.
Figure 8:
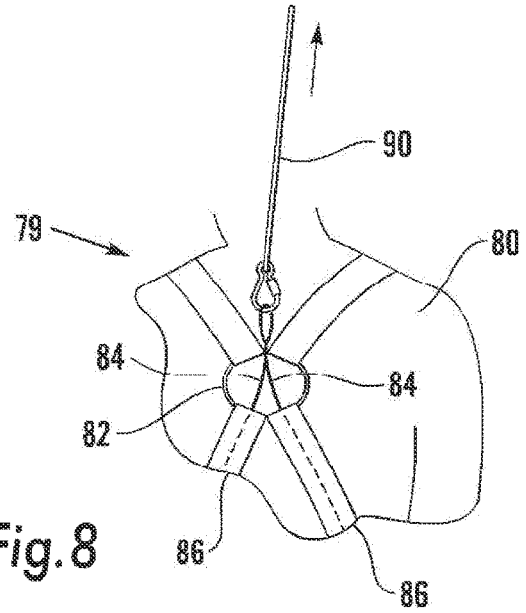
FIG. 8 shows a detail of the third embodiment shown in FIG. 7 when supporting a wearer.

A third embodiment of the harness is shown in FIG. 7. This third embodiment is similar to the second embodiment shown in FIG. 4 in that it includes a pair of overalls 80. The differences from the second embodiment are described below. In other aspects it will be the same as the second embodiment. Above a waist portion, upper guide strap portions 78 of the guide straps 26 extend up a back of the overalls 80. The upper guide straps 78 terminate at and are connected to a ring 82 located on a back of the overalls 80. The cables 84 from the two calf clutching means are respectively routed up passageways 86 formed between the upper guide straps 78 and the overalls to which the upper guide straps are sewn. Each cable extends out of the upper end of the respective passageway 86 and passes through the ring 82. Ends of the cables 84 are provided with loops 88 for connection to a lanyard 90 shown in FIG. 8. Shoulder straps 92 extend from the ring 82 over shoulders of the overalls 80 and down the front of the overalls 80 to a waist strap 14. At the front of the overalls 80 the shoulder straps 92 are releasably fastened to each other to allow the overalls to be put on and taken off easily. When a wearer falls, the lanyard 90 will be tensioned which in turn will tension the cables 84 causing them to be drawn along the passageways 86 and out through the ring 82. As in the first and second embodiments, tensioning of the cables 84 will result in the calf clutching means 12 of each leg of the overalls to clutch the leg of the wearer.

Figure 9:
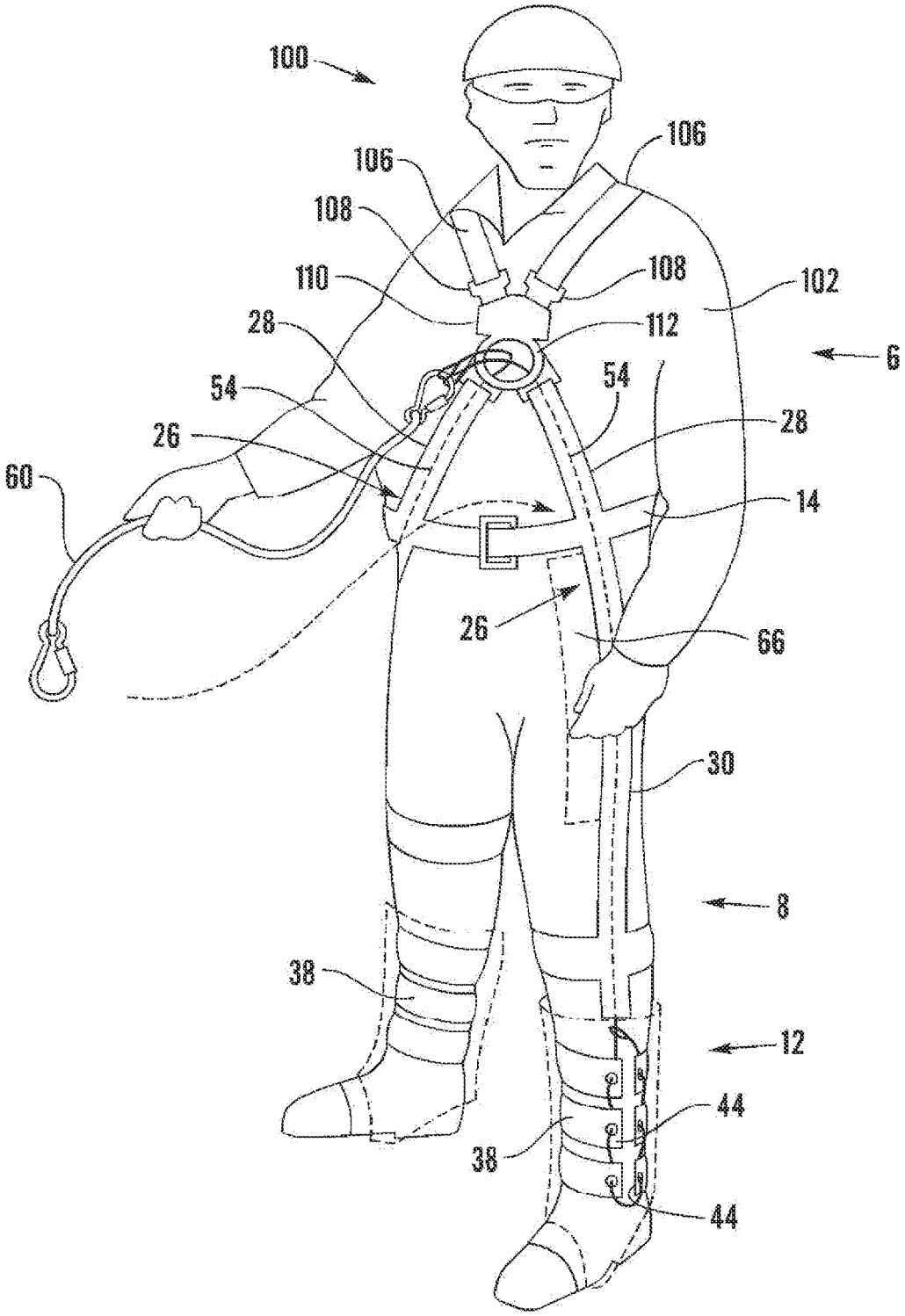
FIG. 9 shows a fourth embodiment of the invention.
Figure 10:
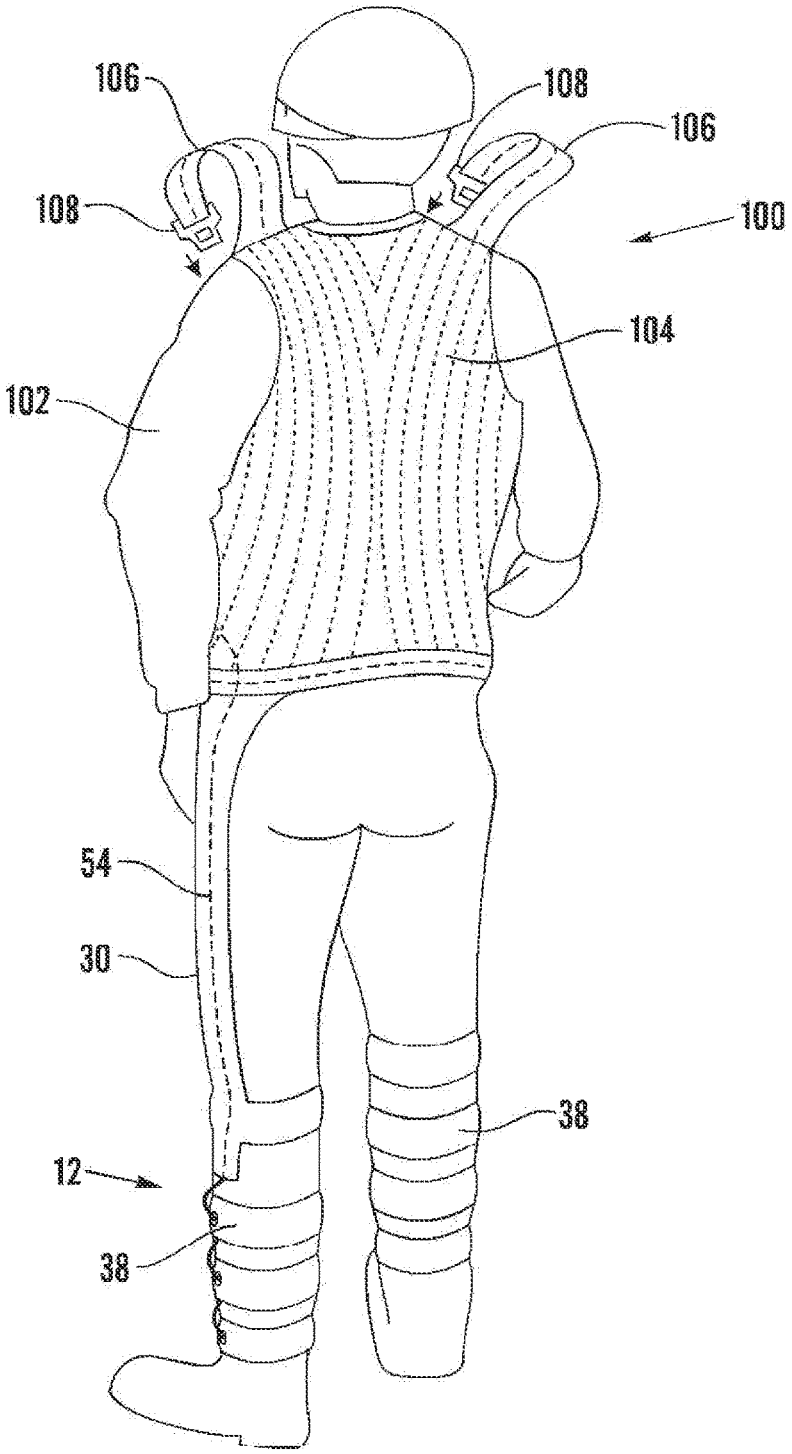
FIG. 10 shows a rear view of the fourth embodiment shown in FIG. 9.

A fourth embodiment 100 of the harness is shown in FIG. 9 which is the same as the second embodiment shown in FIG. 4 except as explained below. Like parts are indicated by the same reference numerals. The harness 100 includes overalls 102 with a reinforced back 104 shown in FIG. 10. A shoulder strap 106 is connected directly to each shoulder of the overalls 102. The end of each shoulder strap 106 has a clip 108 connected to it. Each clip 108 is releasably engageable with a central chest fitting 110 situated on a chest portion of the overalls 102. The chest fitting 110 includes a ring section 112 through which the cables 54 extend. Each upper guide strap 28 may be formed from two pieces of webbing connected to each other as shown in FIG. 6 rather than a single piece of webbing sewn to the overalls.

Figure 11:
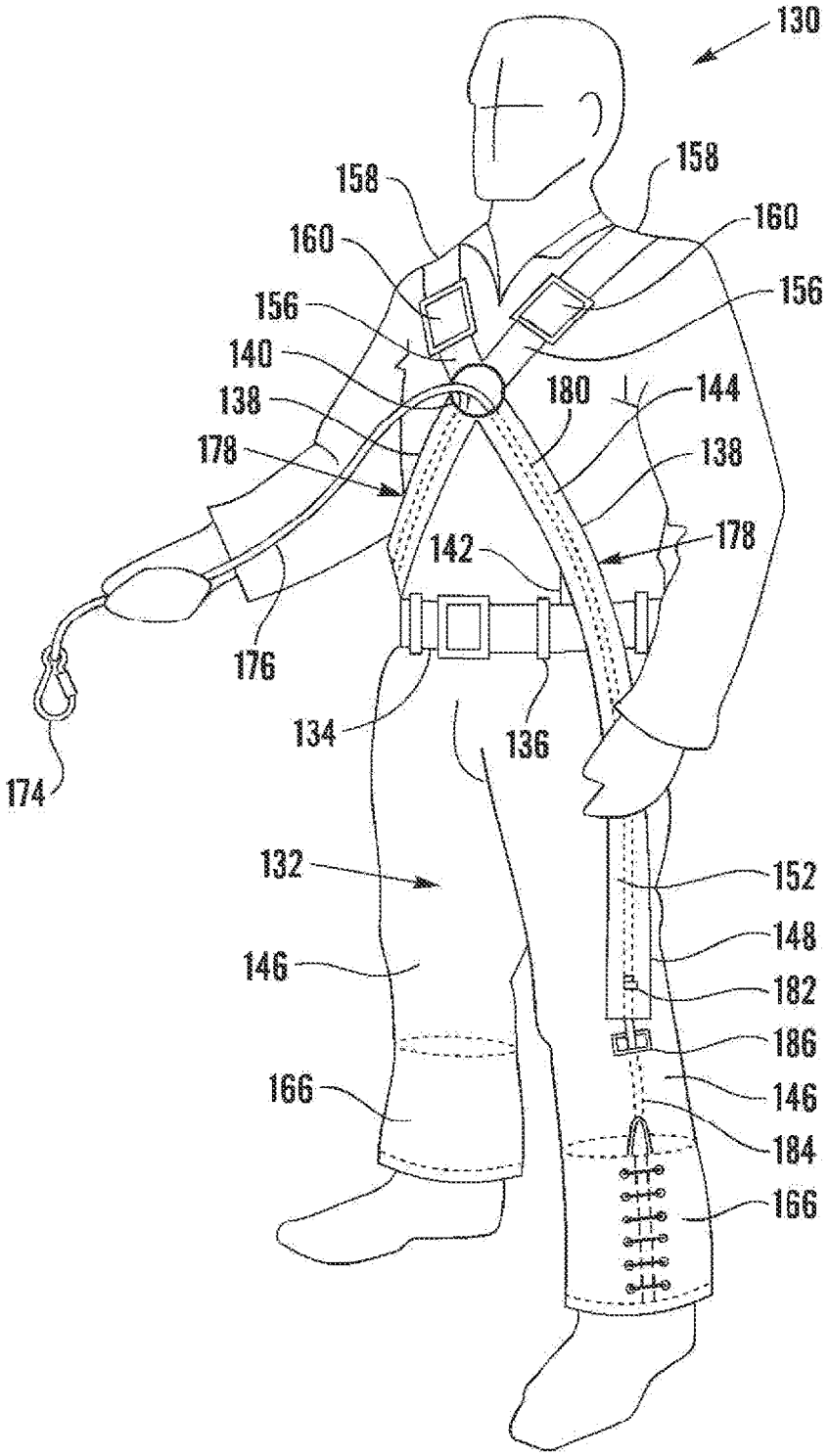
FIG. 11 shows a fifth embodiment of the invention.
Figure 12:
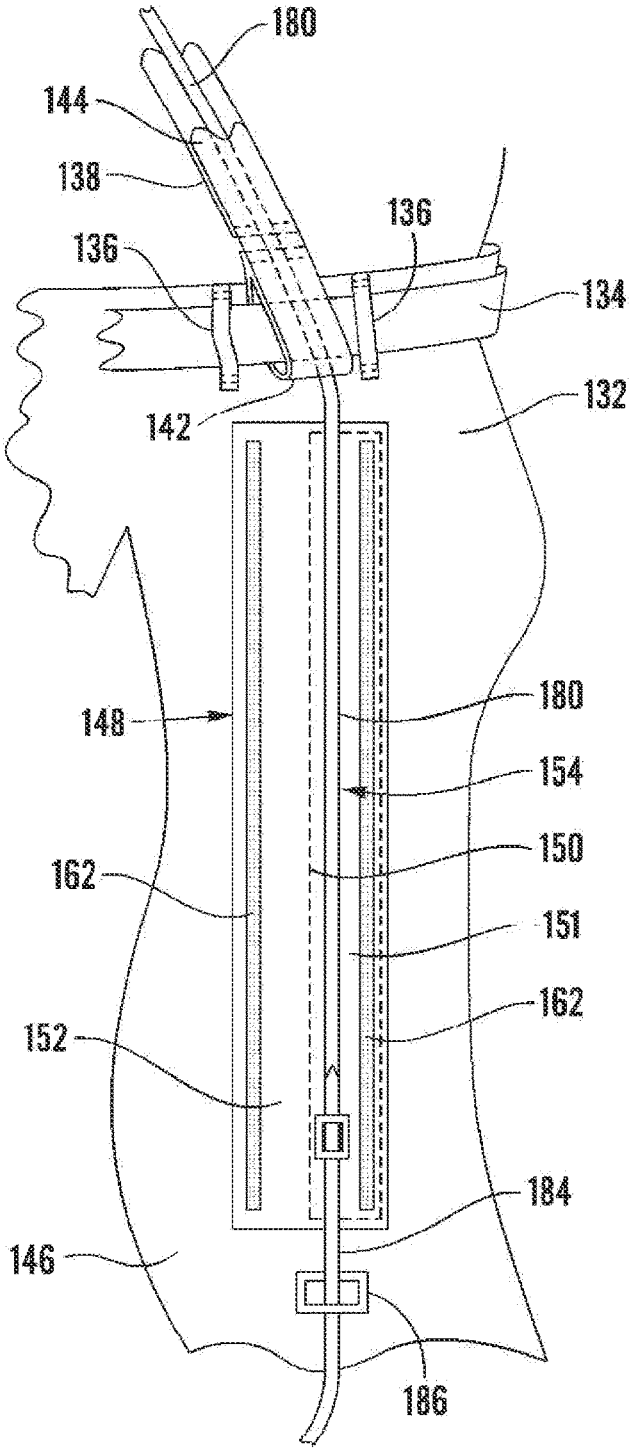
FIG. 12 shows a detail of the fifth embodiment with the lower guide strap open.
Figure 13:
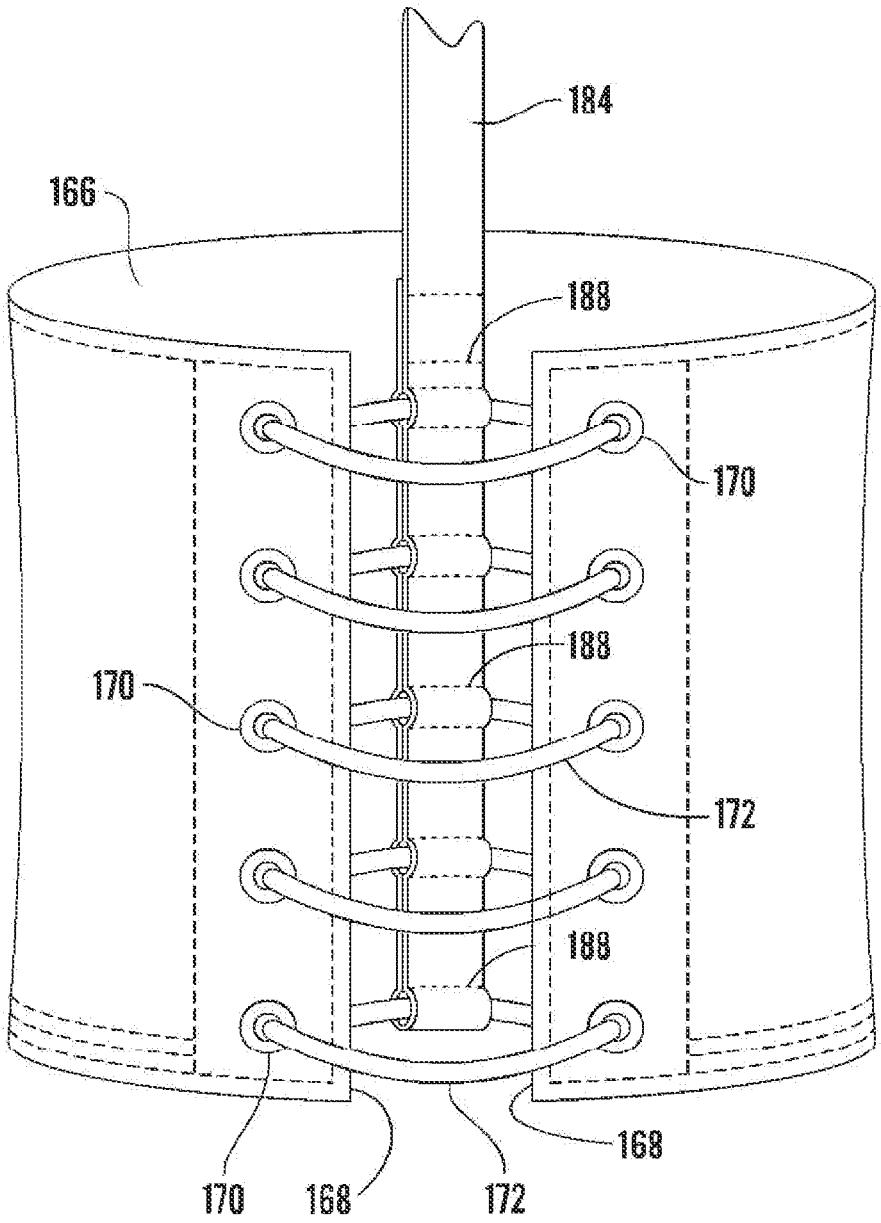
FIG. 13 shows a detail of the calf clutching insert of the fifth embodiment separated from other parts of the harness for the purpose of explanation.

A fifth embodiment of the harness 130 is shown in FIGS. 11 to 13. The harness includes a pair of trousers 132 and other parts which are described in detail below.

The trousers 132 include belt loops 136 through which a webbing belt 134 is threaded. A rigid metal chest ring 140 is provided for being positioned approximately centrally on a wearer's chest. An upper guide strap 138 extends from the chest ring 140 downwardly to each side of a front of the belt and terminates in a loop 142 through which the belt 134 is threaded. Each upper guide strap is made up from two pieces of webbing sewn to each other along their edges 30 as to form a passage 144 which is open at its upper end adjacent to the chest ring 140 and its lower and adjacent to the belt 134.

A pair of webbing shoulder straps 158 extend upwardly from a back portion of the belt 134 for passing over the shoulders of a wearer and each is terminated with a buckle 160 with which a chest strap 156, extending upwardly from the chest ring, is adjustably engageable. Where each shoulder strap 158 is connected to the belt 134 it may be provided with a loop (not shown) through which the belt 134 passes in order to facilitate separation of those parts.

Extending downwardly from the belt 134 on an outer side of each leg 146 of the trousers 132 is a lower guide strap 148. Each lower guide strap is in the form of a length of webbing which is sewn to the respective leg 146 with stitching 150 as shown in FIG. 12. Each lower guide strap 148 includes a fixed portion 151 and a rotatable flap portion 152 which can be opened, as shown in FIG. 12, to provide access to a tensioning means 154 or closed over the fixed portion 151, as shown in FIG. 11, to form a passage 156 along which the tensioning means 154 extends. Fastening means is provided for holding the flap portion 152 in its closed position. The fastening means may be hook and loop fabric joining means 162.

Inside a lower portion of each leg 146 a reinforcing calf clutching means 166 is sewn which is shown in detail in FIG. 13. Each calf clutching means 166 has confronting ends 168 with a row of reinforcing eyelets 170 spaced therealong. A loop 172 of cord, wire or any suitable material interconnects adjacent eyelets in the confronting ends 168. The calf clutching means 166 are shown in FIG. 11 for the purpose of explanation but would not be visible in reality as they are inside the legs 146 of the trousers.

Harness attachment means in the form of a clip 174 and lanyard 176, which may be of webbing, are connected to tensioning means 178 which extend to the two calf clutching means 166. The tensioning means 178 on each side of the harness includes upper tensioning means 180 which extends from the chest ring 140, down the passage 144 in the upper guide strap and through an upper portion of the passage 156 in the lower guide strap 148, to a fastening means 182 which may be in the form of a buckle or carribener. The fastening means 182 is positioned adjacent a lower end of the respective lower guide strap 148. The fastening means 182 connects the upper tensioning means 180 to a lower tensioning means 184 which constitutes a further part of the tensioning means 178 and which extends out of a lower end of the lower guide strap 148, through a hole 186 between the lower guide strap 148 and the calf clutching means 166 into an interior of the leg 146.

At the calf clutching means 166 the lower tensioning means 184 is connected to one side of each loop 172, possibly by stitching 188 or some other connection means. Both the upper and lower tensioning means 180, 184 may conveniently be in the form of webbing which will cause less wear than steel cables. Furthermore the upper tensioning means 180 may constitute an integral extension of the lanyard 176 which may also be composed of webbing.

If a wearer falls with the clip 174 attached to some form of restraint, the lanyard 176 tensions the upper and lower tensioning means 180, 184. This in turn will draw portions of the loops 172 to which each lower tensioning means is connected upwardly. This will have the consequence of urging confronting ends 168 of each calf clutching means 166 towards each other which will result in each calf clutching means 166 gripping the respective calf of the wearer.

The lower end of each leg 146 may be provided with an adjustable ankle strap such as that shown in FIG. 3 or some other tightening means for preventing the leg riding up a wearer's leg into a no-optimum position.

If there is a requirement to clean the trouser part of the harness, the belt will be removed thus releasing two back parts of the shoulder straps 158 and the upper guide straps 138. The hook and loop fabric fastening means 162 will be released so that the flap portions 152 of the lower guide straps 148 can be opened, and each lower tensioning means 184 will be released from its associated upper tensioning means 180 at the buckle 182. All portions of the harness normally positioned above the belt 134 together with the upper tensioning means 180 will then be removed in order that the trousers 132 and all other parts of the harness can be cleaned.

Features described above from different embodiments may be combined in combinations differing from those shown in the embodiments described.

Various modifications to the harness, which fall within the scope of the accompanying claims, will be apparent to those skilled in the art and the embodiments have been described above by way of example only.

The invention claimed is:

1. A safety harness including:

a support attachment and flexible calf clutching members for at least partly supporting a wearer of the harness by each calf clutching member clutching a respective calf of the wearer, the harness being configured such that applying a support load to the support attachment causes a reduction in a total perimeter dimension and tightening of each calf clutching member around the calf of the wearer thereby causing clutching of the each calf clutching member around a respective calf of the wearer; and a tensioning portion which extends from the support attachment to a lower harness portion including one of the calf clutching members, wherein the tensioning portion is arranged to run through an upper harness portion.

2. The harness of claim 1 wherein the tensioning portion runs through a protective sheath.

3. The harness of claim 1 wherein the flexible calf clutching members are each configured to extend round a respective leg of the wearer, and wherein the tensioning portion is arranged to urge portions of each flexible calf clutching member toward each other thereby causing the flexible calf clutching member to clutch a calf of the wearer when the tensioning portion is tensioned.

4. The harness of claim 1 wherein the tensioning portion is laced between portions of one of the flexible calf clutching members whereby tensioning of the tensioning portion urges the portions of the one flexible calf clutching member toward each other for clutching the calf of the wearer.

5. The harness of claim 1 wherein the tensioning portion includes lacing, and portions of the flexible calf clutching members are connected by the lacing whereby the portions of the flexible calf clutching members are urged towards each other when the tensioning portions are tensioned.

6. The harness of claim 1 further including an item of clothing selected from a pair of trousers and a pair of overalls, the item of clothing connected to the harness.

7. The harness of claim 6 wherein bottoms of legs of the item of clothing include the calf clutching members so as to grip ankles of the wearer.

8. The harness of claim 1 including an item of clothing and wherein the tensioning portion is at least partly routed by connection to the item of clothing.

9. The harness of claim 1 including covers for at least partly covering the respective calf clutching members to prevent parts thereof from being snagged.

10. The harness of claim 1 wherein the calf clutching members each includes a clenchable gaiter for each leg of the wearer.

11. The harness of claim 1 further comprising a retention portion for retaining a portion of the support attachment when the harness is worn but not connected to an external restraint.

12. The harness of claim 1 including a pair of stirrups selectively deployable from the harness to provide support to undersides of feet of a wearer.

13. A safety harness including:

a support attachment and flexible calf clutching members for at least partly supporting a wearer of the harness by each calf clutching member clutching a respective calf of the wearer, the harness being configured such that applying a support load to the support attachment causes a reduction in a total perimeter dimension and tightening of each calf clutching member around the calf of the wearer thereby causing clutching of the each calf clutching member around a respective calf of the wearer;

a tensioning portion which extends from the support attachment to a lower harness portion including one of the calf clutching members; and an item of clothing further including a guide connected to the item of clothing defining a passage through which the tensioning portion extends, wherein the guide is openable along its length to facilitate separation of the item of clothing from the harness.

14. The harness of claim 13 wherein the flexible calf clutching members are each configured to extend round a respective leg of the wearer, and wherein the tensioning portion is arranged to urge portions of each flexible calf clutching member toward each other thereby causing the flexible calf clutching member to clutch a calf of the wearer when the tensioning portion is tensioned.

15. The harness of claim 13 wherein the tensioning portion is laced between portions of one of the flexible calf clutching members whereby tensioning of the tensioning portion urges the portions of the one flexible calf clutching member toward each other for clutching the calf of the wearer.

16. The harness of claim 13 wherein the tensioning portion includes lacing, and portions of the flexible calf clutching members are connected by the lacing whereby the portions of the flexible calf clutching members are urged towards each other when the tensioning portions are tensioned.

17. The harness of claim 13 including covers for at least partly covering the respective calf clutching members to prevent parts thereof from being snagged.

18. The harness of claim 13 wherein the calf clutching members each includes a clenchable gaiter for each leg of the wearer.

19. The harness of claim 13 further comprising a retention portion for retaining a portion of the support attachment when the harness is worn but not connected to an external restraint.

20. The harness of claim 13 including a pair of stirrups selectively deployable from the harness to provide support to undersides of feet of a wearer.

* * * * *